US007658232B2

(12) United States Patent
Anderson et al.

(10) Patent No.: US 7,658,232 B2
(45) Date of Patent: Feb. 9, 2010

(54) FIRE SAFETY SYSTEMS FOR BUILDINGS WITH OVERHEAD FANS

(75) Inventors: Daniel M. Anderson, Oak Creek, WI (US); Ronald P. Snyder, Dubuque, IA (US); Aaron J. Wiegel, Benton, IA (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 18 days.

(21) Appl. No.: 12/014,518

(22) Filed: Jan. 15, 2008

(65) Prior Publication Data

US 2009/0178815 A1 Jul. 16, 2009

(51) Int. Cl.
*A62C 37/10* (2006.01)

(52) U.S. Cl. ..... 169/61; 169/5; 169/37; 169/54; 169/91

(58) Field of Classification Search ..... 239/5, 239/16, 37, 43, 46, 47, 54, 61, 91; 169/5, 169/16, 37, 43, 46, 47, 54, 61, 91; 454/342
See application file for complete search history.

(56) References Cited

U.S. PATENT DOCUMENTS 2,311,374 A 2/1943 Farmer et al.
2,586,797 A 2/1952 Dunlop et al.
5,562,164 A * 10/1996 McMurray ..... 169/54
5,607,021 A * 3/1997 Steele et al. ..... 169/54
2002/0155807 A1 10/2002 Moor et al.
2004/0084544 A1 5/2004 Boyd et al.
2007/0036654 A1 2/2007 Fedeli et al.

FOREIGN PATENT DOCUMENTS

DE 19841934 3/2000
JP 08126716 5/1996

OTHER PUBLICATIONS

International Searching Authority, "International Search Report," issued in connection with counterpart international application No. PCT/US2008/084385, mailed Feb. 19, 2009, 4 pages.
International Searching Authority, "Written Opinion of the International Searching Authority," issued in connection with international application No. PCT/US2008/084385, mailed Feb. 19, 2009, 7 pages.

* cited by examiner

*Primary Examiner*—Steven J Ganey
(74) *Attorney, Agent, or Firm*—Hanley, Flight & Zimmerman, LLC

(57) ABSTRACT

A fire safety system includes a sensor arrangement and control scheme for quickly sensing a fire, accurately identifying its location, and controlling a set of ceiling fans and overhead sprinklers to efficiently extinguish the fire. The fire safety system is particularly suited for large buildings such as warehouses, factories, gymnasiums, retail stores, auditoriums, convention centers, theaters or other buildings with large open areas. In some examples, the overhead fans are disabled prior to activating the sprinklers. The placement of the fire sensors, in some cases, are selected upon first considering the location of the overhead fans.

12 Claims, 4 Drawing Sheets

FIRE SAFETY SYSTEMS FOR BUILDINGS WITH OVERHEAD FANS

FIELD OF THE DISCLOSURE

This disclosure relates generally to a fire safety systems for buildings with overhead fans, and more specifically, to a system that disables a fan in response to a fire.

BACKGROUND

Ceiling mounted fans are often used for circulating air within large buildings such as warehouses, factories, gymnasiums, retail stores, auditoriums, convention centers, theaters, or other buildings with large open areas. For fire safety, a matrix of overhead sprinklers are usually installed to quench any fires that might occur within the building.

To detect a fire and control the operation of the fans and sprinklers appropriately, various types of fire sensors are available. They usually operate by optical detection (photoelectric), chemical reaction (ionization), or heat detection (fusible link or infrared sensor for radiation).

Some optical photoelectric smoke detectors comprise an infrared light beam passing at a right angle in front of a photodiode or other photoelectric light sensor. In the absence of smoke, the light beam passes undetected in front of the light sensor. Smoke particles, however, can scatter the light beam into the sensor and trigger the smoke detector.

In other types of optical photoelectric smoke detectors, known as projected beam detectors, an emitter projects a light beam across a room where a distant light receiver senses the intensity of the beam. When smoke disperses the beam, the receiver provides an alarm signal in response to sensing reduced light.

Ionization style smoke detectors emit alpha radiation to create a small electrically conductive ionized path between two electrodes. When smoke absorbs the alpha particles, the smoke disturbs the ionized path and interrupts the current between the electrodes, thereby triggering the detector.

Some fire detectors (e.g., heat detectors) are in the form of a fusible link incorporated within a sprinkler head. The fusible link holds a valve of the sprinkler closed until sufficient heat from the fire melts or otherwise destroys the link, thereby activating the sprinkler.

In many cases, the sprinklers are fed by a pressure vessel containing a limited supply of water that is at a pressure higher than that of the municipal water that fills the pressure vessel. This allows an individual sprinkler or a group of sprinklers in a single zone of a multi-zone system to rapidly and intensely focus high-pressure water at a localized area before the fire has time to spread.

If the location of the fire is not accurately determined and, as a result, the wrong sprinklers are activated, this can waste the high-pressure water on an area that does not need it. Depleting the limited supply of high-pressure water in this manner might allow the fire to spread with only lower pressure water, if any, left to suppress it.

DETAILED DESCRIPTION

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity.

Figure 1:
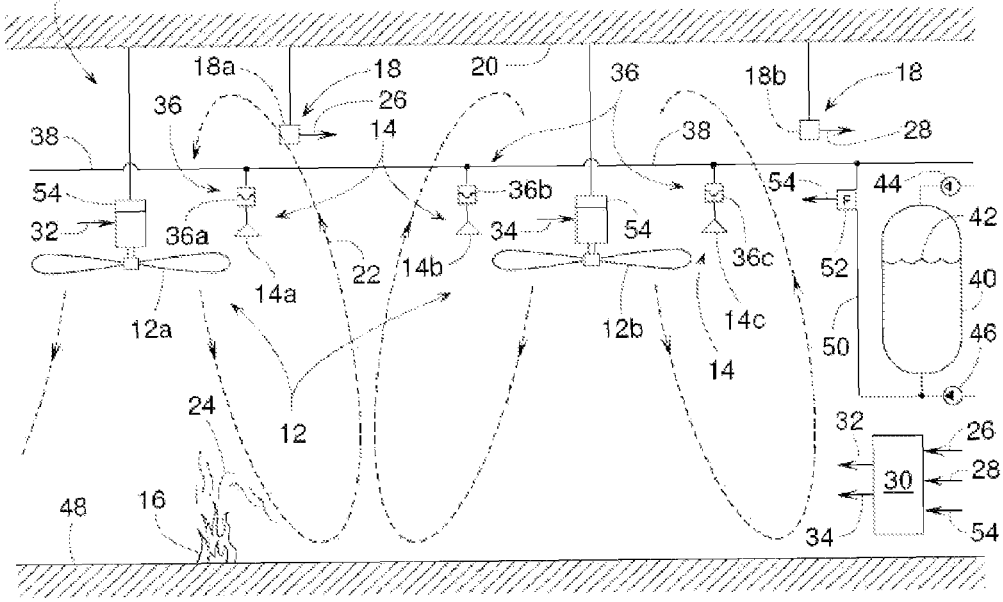
FIG. 1 is a schematic diagram of an example fire safety system.

A need exists for a fire safety system that can quickly sense a fire, accurately identify its location, and control a series of ceiling fans and overhead sprinklers to efficiently extinguish the fire. FIG. 1 illustrates an example fire safety system 10 for a building that has one or more overhead fans 12 (e.g., 12*a* and 12*b*) for air circulation and at least one of a plurality of sprinklers 14 (e.g., 14*a*, 14*b* and 14*c*) for extinguishing a fire 16. Any number of fans 12 (e.g., 1, 3, 4, 5, etc.) and any number of sprinklers 14 (e.g., 1, 2, 4, 5, etc.) may be used. The term, "fire" used herein refers to any burning event or state of combustion including, but not limited to, an open flame and flameless smoldering. In the event of fire 16, the activation of sprinklers 14 and deactivation of fans 12 are controlled in response to one or more sensors that are able to sense or react to a characteristic associated with fire 16. Examples of characteristics associated with fire include, but are not limited to, heat, smoke and light.

Activation of a sprinkler means that a sprinkler valve opens or a "sprinkler turns on" to spray or otherwise discharge a fire-extinguishing fluid (e.g., water, or any other suitable substance). Deactivation of a fan means that a "fan turns off" (i.e., the fan blades decelerate and may stop rotating). Depending on the particular control scheme and type of sensors being used, sprinklers 14 in the vicinity of fire 16 can be selectively activated individually, in zone groups, or all of the sprinklers can be activated together. Likewise, the deactivation of fans 12 may be done selectively or as a group.

Examples of sensors that can sense or react to a characteristic associated with fire 16 include, but are not limited to, optical detectors, ionization detectors, heat detectors and combinations thereof. Information on various types of sensors is provided herein under the section entitled, "Background."

In the illustrated example of FIG. 1, sensors 18 (sensors 18*a* and 18*b*) are smoke detectors (e.g., optical, ionization or any other suitable type of smoke detector) that are installed near the building's ceiling 20 where relatively warm smoke tends to collect during, for example, fire 16. In some cases, sensors 18 are positioned in updrafts created by fans 12. Sensor 18*a*, for example, is positioned in an updraft 22 of fan 12*a* such that sensor 18*a* may quickly sense smoke 24 being drawn up by the rising current of air returning to fan 12*a*. In response to detecting smoke 24 from fire 16, sensors 18 provide signals 26 and/or 28. Signals 26 and 28 can be conveyed (e.g., transmitted) to a common controller 30 (e.g., programmable logic controller, computer, processor logic circuit, electromagnetic relay circuit, etc.) that in turn provides output signals 32 and/or 34 to deactivate fans 12*a* and/or 12*b*. Alternatively, signals 26 and/or 28 may be conveyed directly to control wiring (not shown) within fans 12*a* and/or 12*b* to selectively deactivate the fans 12*a* and 12*b* without the use of controller 30.

Still referring to the example of FIG. 1, sensors 36 (e.g., 36*a*, 36*b* and 36*c*) are heat detectors such as, for example, conventional fusible links that upon sufficient exposure to heat from fire 16 melt to actuate sprinklers 14, or any other suitable type of heat detectors (e.g., thermocouple heat detectors, electro-pneumatic heat detectors). Sensors 36 can be supported by or incorporated within sprinklers 14 in any disclosed manner.

In the illustrated example of FIG. 1, the sprinklers 14 are fed by a common pipe 38 that is connected to a pressure vessel 40. Alternatively, sprinklers 14 may be fed by individual pipes (not shown) that are each connected to pressure vessel 40. Pressure vessel 40 contains a certain volume of fire-extinguishing fluid 42 (e.g., water, or any other suitable substance) that may be maintained at a relatively high pressure via, for example, an air compressor 44. If one or more sprinklers 14 turn on, for example, due to their respective fusible link melting under the heat of fire 16, those open sprinklers may spray the high-pressure fluid 42 onto fire 16. After one or more sprinklers 14 discharge the certain volume of fluid 42 from pressure vessel 40, the compressor 44 may be turned off while a pump 46 or other fluid supply (not shown) continues feeding sprinklers 14 with fluid albeit at an appreciably lower pressure and volume relative to the high-pressure fluid 42 from pressure vessel 40.

Should fire 16 occur near a floor 48 of the building or elsewhere, example fire safety system 10 may respond with the following sequence of events. Before sensors 18 or 36 detect fire 16, fans 12 are running normally while sprinklers 14 are inactive. As smoke 24 rises from fire 16, sensor 18*a* detects the smoke and deactivates fan 12*a* and fan 12*b*. With all of the fans 12 or at least the ones nearest fire 16 being inactive, air currents diminish (e.g. decrease). This calm period allows fire safety system 10 to more accurately determine the location of fire 16. With the fans 12*a* and/or 12*b* turned off, heat from fire 16 can rise in a more direct upward path. The rising heat thus is more likely to be detected by the sensor 36 that is closest to fire 16. In this example, sensor 36*a* is first to detect the heat, so sensor 36*a* transmits a signals that turns on sprinkler 14*a* while the other sprinklers remain inactive. Sprinkler 14*a* can then spray the full high-pressure volume of fluid 42 directly onto fire 16 without the other sprinklers wasting fluid 42 on areas that do not need it. In the illustrated example, as fluid 42 flows through a supply line 50, a flow detector 52 provides a signal 54 that triggers a fire alarm (not shown) and/or deactivates compressor 44.

In the illustrated example, although a time period with relatively calm air may elapse between the moment at which sensor 18*a* first detects smoke and the time at which sprinkler 14a turns on, this period can be minimized by stopping fan 12*a* as quickly as possible in response to sensor 18*a* detecting smoke. To do this, fans 12 can each be provided with a mechanical and/or electrical brake 54 (e.g., a frictional and/or dynamic brake). In some example implementations, to prolong the life of brake 54, the brake may only be activated when fan 12 is turned off in response to a fire (e.g., turned off in response to sensor 18); otherwise, fan 12 could be allowed to simply coast to a stop when deactivated under normal operating conditions.

Figure 2:
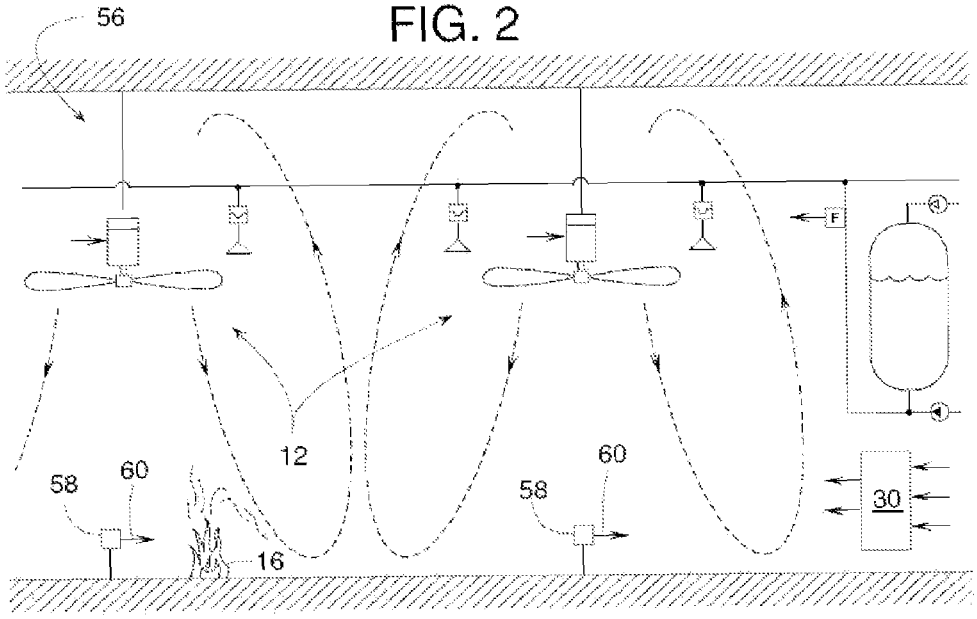
FIG. 2 is a schematic diagram of another example fire safety system.

To sense the occurrence of fire 16 more quickly and determine its location more accurately, an example fire safety system 56 of FIG. 2 includes sensors 58 that are installed closer to floor 48. Sensors 58 are schematically illustrated to represent any detector capable of sensing a fire-related characteristic including, but not limited to, heat, smoke and light. Examples of sensors 58 include, but are not limited to, optical detectors, fusible links, ionization detectors, and combinations thereof. Upon sensing fire 16, sensors 58 provide feedback signals 60 that can be used for deactivating fans 12 individually or as a group. Signals 60 can be conveyed to fans 12 via controller 30, sensors 58 can be hardwired directly to fans 12, or signals 60 can be conveyed to fans 12 via a wireless communication link (e.g. radio waves, infrared, etc.). Other than a difference in response time and accuracy of locating a fire, fire safety system 56 operates similar to fire safety system 10.

Figure 3:
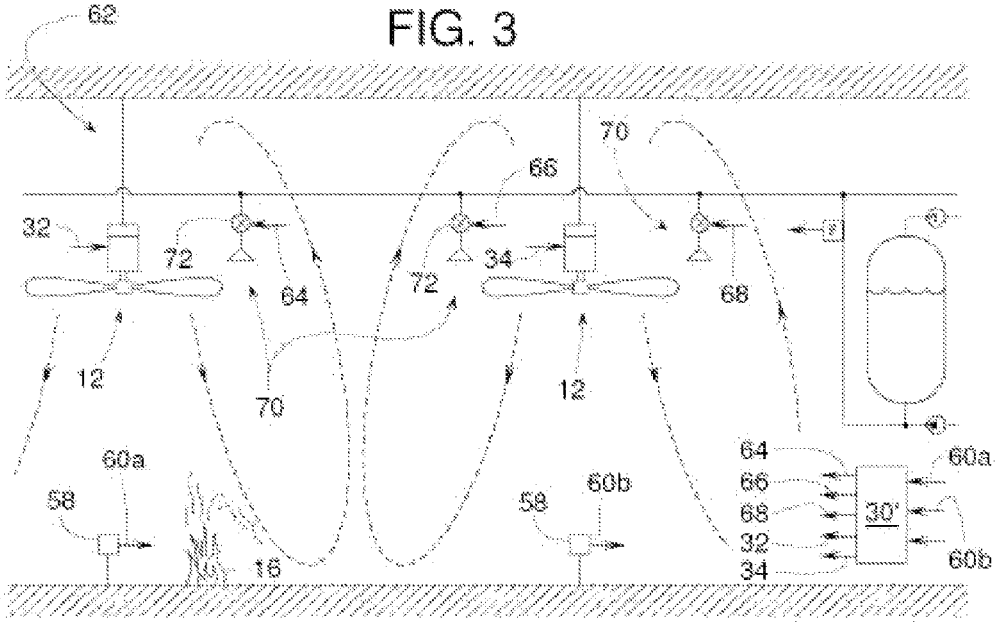
FIG. 3 is a schematic diagram of another example fire safety system.

For even greater response to fire 16, an example fire safety system 62 of FIG. 3 uses signals 60*a* and 60*b* to activate sprinklers 70 individually or as a group. Instead of waiting until heat from fire 16 reaches the sensors 36 (e.g., the fusible link), as is the case with fire safety systems 10 and 56, sprinklers 70 are activated by electric valves 72 that are responsive to signals 64, 66 and 68. Signals 60*a* and 60*b* can be processed by a controller 30' to determine which sprinklers 70 should be activated and which fans 12 should be turned off. Upon considering signals 60*a* and/or 60*b*, controller 30' provides signals 64, 66 and/or 68 to control sprinklers 70 and provides signals 32 and/or 34 to control fans 12. The transmission of the various signals may be done through hardwiring or wireless communication.

Figure 4:
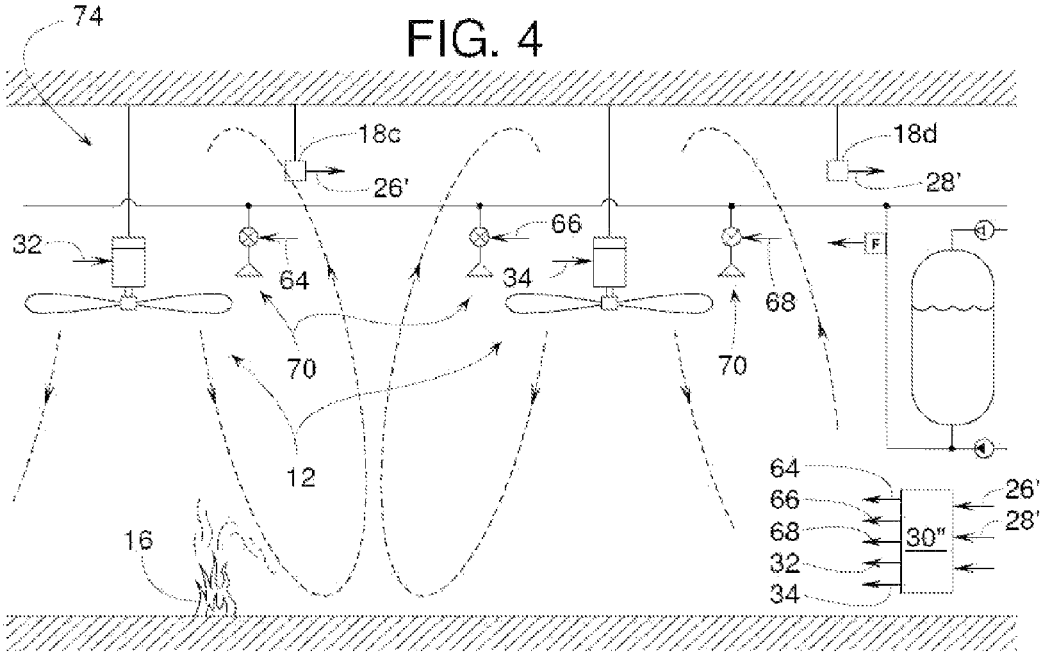
FIG. 4 is a schematic diagram of yet another example fire safety system.

In cases where installing fire detectors near a floor is not feasible, an example fire safety system 74 of FIG. 4 might be more practical. Fire safety system 74 includes overhead sensors 18*c* and 18*d* that respond to two predetermined limits of smoke concentration. When the smoke reaches a first lower limit, sensors 18*c* and/or 18*d* provide signals 26' and/or 28' to a controller 30" to turn off one or more fans 12. When the concentration of smoke reaches a second higher limit, sensor 18*c* and/or 18*d* sends a signal to turn on one or more sprinklers 70 to turn on. During the period between reaching the two limits, the air within the building is relatively calm (e.g., the fans are turned off), which allows smoke to collect in an area generally above fire 16, thereby enabling system 74 to selectively actuate the correct sprinklers 70.

In some example implementations, recognizing two limits of smoke concentration can be accomplished by installing two sets of smoke detectors, wherein one set of smoke detectors is more sensitive than the other. The more sensitive smoke detectors may deactivate fans 12, and the less sensitive smoke detectors may activate sprinklers 70. It is also conceivable and well within the scope of the disclosure to provide a single smoke detector with logic that distinguishes multiple levels of smoke concentration.

Figure 5:
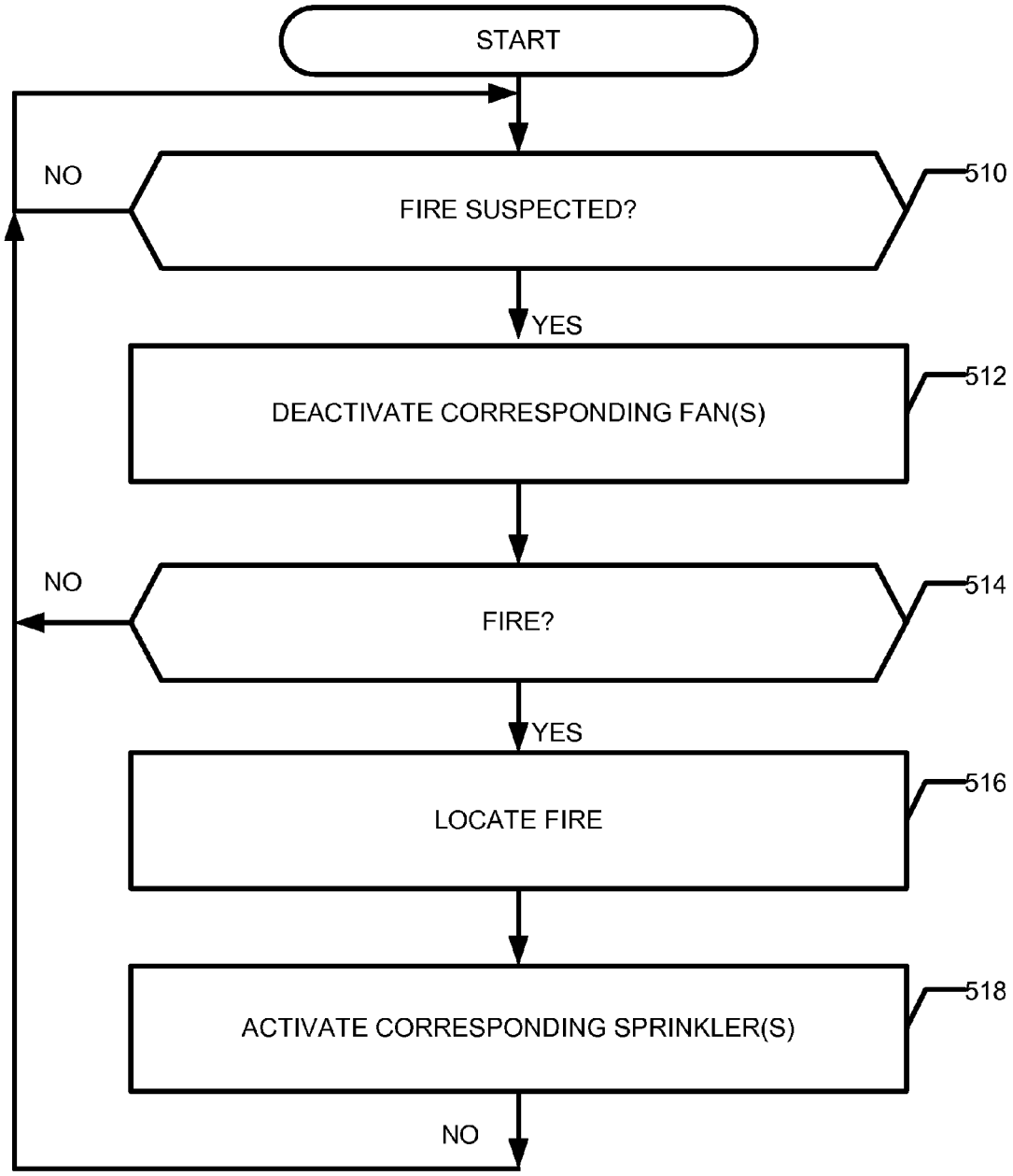
FIG. 5 is a flow chart representative of machine readable instructions that may be executed by any of the controllers of FIGS. 1-4 to implement a method or apparatus described herein.
Figure 6:
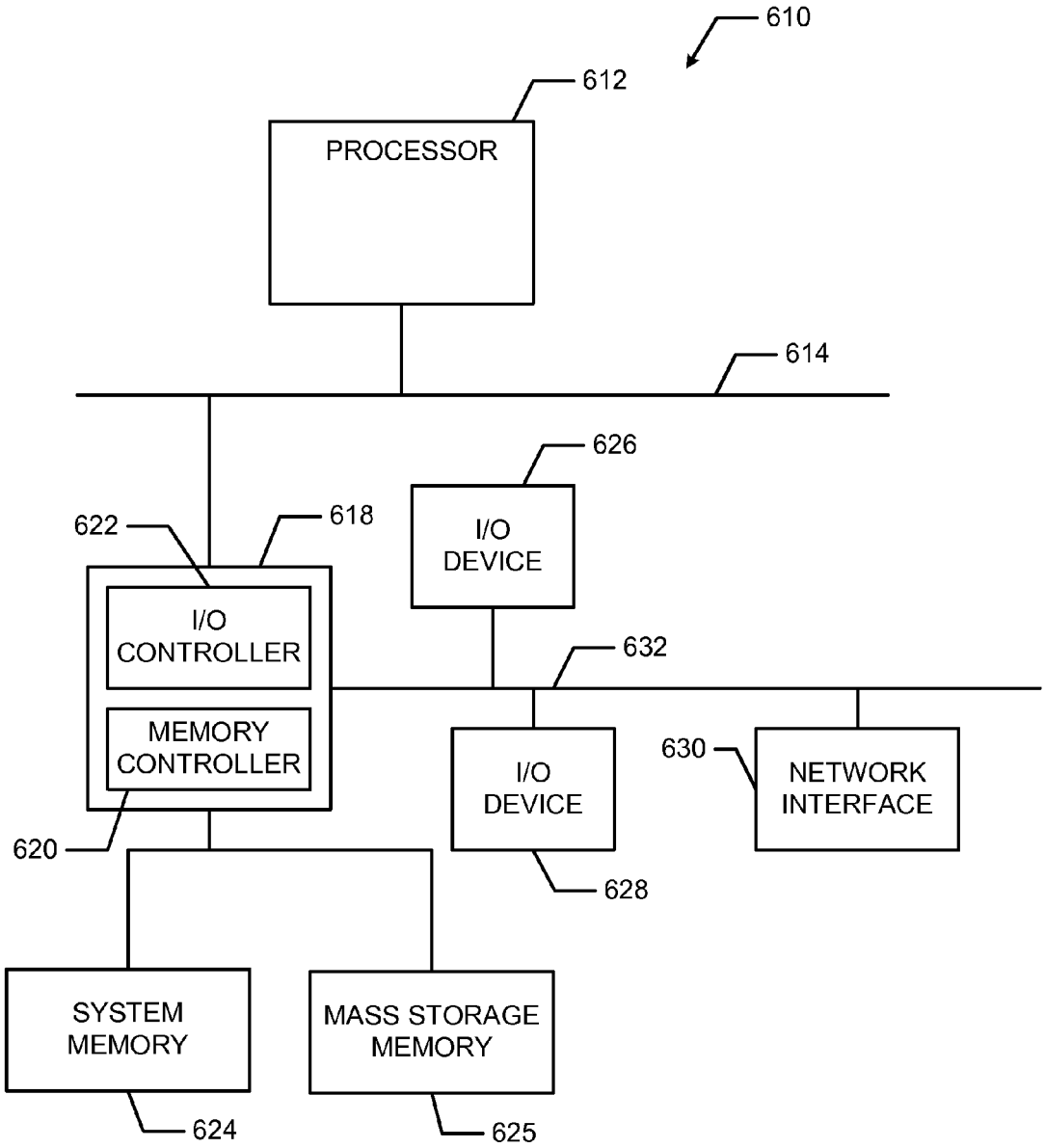
FIG. 6 illustrates an example manner of implementing any of the controllers of FIGS. 1-4.

In operation, the fire safety systems of FIGS. 1-4 can perform the following process illustrated in FIG. 5. The process of FIG. 5 is representative of machine readable instructions which may be executed by any of the controllers 30, 30', 30". FIG. 6 illustrates an example manner of implementing any of the controllers 30, 30', 30". However, other methods to implement the fire safety systems of FIGS. 1-4 may additionally or alternatively be used. Further, in some example implementations, one or more portion(s) of the following process may be combined, rearranged, or deleted.

The example process of FIG. 5 begins when a sensor detects a condition that a fire may be present (block 510). When a fire is suspected (block 510), the controller 30, 30', 30" deactivates the fan(s) in the area of the suspected fire (block 512).

The controller then reads the output(s) of the sensor(s) in the area of the suspected fire to determine if a fire exists (block 514). If no fire is detected, control returns to block 510. An alarm may be sounded to request a manual check for fire and/or re setting the system.

If a fire is detected (block 514), the controller determines the approximate location of the fire within the building based on the outputs of the sensor(s) (block 516). The controller 30, 30', 30" then actuates one or more sprinkler(s) corresponding to the approximate location (block 518). Control then return to block 510 to monitor for fire starting in any other area(s) of the building.

The instructions represented by FIG. 5 may be implemented by multiple threads operating in parallel.

FIG. 6 is an example manner of implementing the controller 30, 30', 30". FIG. 6 is a block diagram of an example processor system 610 that may be used to implement the apparatus and methods described herein. As shown in FIG. 6, the processor system 600 includes a processor 612 that is coupled to an interconnection bus 614. The processor 612 may be any suitable processor, processing unit or microprocessor. Although not shown in FIG. 6, the system 610 may be a multi-processor system and, thus, may include one or more additional processors that are identical or similar to the processor 612 and that are communicatively coupled to the interconnection bus 614.

The processor 612 of FIG. 6 is coupled to a chipset 618, which includes a memory controller 620 and an input/output (I/O) controller 622. As is well known, a chipset typically provides I/O and memory management functions as well as a plurality of general purpose and/or special purpose registers, timers, etc. that are accessible or used by one or more processors coupled to the chipset 618. The memory controller 620 performs functions that enable the processor 612 (or processors if there are multiple processors) to access a system memory 624 and a mass storage memory 625.

The system memory 624 may include any desired type of volatile and/or non-volatile memory such as, for example, static random access memory (SRAM), dynamic random access memory (DRAM), flash memory, read-only memory (ROM), etc. The mass storage memory 625 may include any desired type of mass storage device including hard disk drives, optical drives, tape storage devices, etc.

The I/O controller 622 performs functions that enable the processor 612 to communicate with peripheral input/output (I/O) devices 626 and 628 and a network interface 630 via an I/O bus 632. The I/O devices 626 and 628 may be any desired type of I/O device such as, for example, a keyboard, a video display or monitor, a mouse, etc. The network interface 630 may be, for example, an Ethernet device, an asynchronous transfer mode (ATM) device, an 802.11 device, a DSL modem, a cable modem, a cellular modem, etc. that enables the processor system 610 to communicate with another processor system.

While the memory controller 620 and the I/O controller 622 are depicted in FIG. 6 as separate functional blocks within the chipset 618, the functions performed by these blocks may be integrated within a single semiconductor circuit or may be implemented using two or more separate integrated circuits.

At least some of the aforementioned examples include one or more features and/or benefits including, but not limited to, the following:

In some examples, a fire sensor is installed near the floor or at least below both a sprinkler and a fan.

In some examples, a fire safety system includes one fire sensor for disabling a fan and a second fire sensor for activating a sprinkler.

In some examples, a fire safety system disables a fan before activating a sprinkler.

In some examples, a fire safety system uses the time between disabling a fan and activating a sprinkler to help identify the location of a fire.

In some examples, a fire safety system includes a fan associated with a smoke detector and a sprinkler associated with a heat detector (e.g., fusible link).

In some examples, an overhead fan includes a brake for quickly stopping the fan in the event of a fire.

In some examples, a fire safety system coordinates the operation of a fan, a sprinkler, and a pressure vessel containing a certain volume of pressurized fire-extinguishing fluid.

In some examples, a fire sensor is positioned within the updraft of an overhead fan.

In some examples, a fire safety system includes a sensor system (one sensor or a plurality of sensors) responsive to two limits of smoke concentration.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

The invention claimed is:

1. A fire safety system responsive to a fire in a building, the fire safety system comprising:

a first sensor to sense a characteristic associated with the fire, the first sensor being located in a first room of the building;

a ceiling fan located in the first room at a first elevation above the first sensor, the ceiling fan being communicatively coupled to the first sensor to receive a signal to turn off in response to the first sensor sensing the characteristic associated with the fire; and a sprinkler located in the first room at a second elevation above the first sensor, the first sensor being located closer to a floor of the first room than are the ceiling fan and the sprinkler.

2. The fire safety system of claim 1, further comprising a second sensor located in the first room, the second sensor being responsive to the fire to activate the sprinkler, the second sensor being located at a third elevation above the first sensor.

3. The fire safety system of claim 2, wherein the second sensor is supported by the sprinkler.

4. A fire safety system to be disposed between a floor and a ceiling of a room in a building, the fire safety system being responsive to a fire to activate a sprinkler in the room, the fire safety system comprising:

a sensor system to sense a characteristic associated with the fire; and a ceiling fan to be mounted to the ceiling, the ceiling fan including a brake to stop the ceiling fan in response to the sensor system sensing the characteristic associated with the fire and before the sprinkler turns on.

5. The fire safety system of claim 4, wherein the sprinkler is one of a plurality of sprinklers, the sensor system includes a plurality of sensors, and the sensor system includes a controller operatively coupled to the ceiling fan and the plurality of sprinklers, wherein the controller selects at least one sprinkler in the plurality of sprinklers to be activated based on feedback from the plurality of sensors during a period between when the ceiling fan turns off and the sprinkler turns on.

6. The fire safety system of claim 4, wherein the sensor system includes a smoke detector associated with the ceiling fan and a heat detector associated with the sprinkler.

7. The fire safety system of claim 4, further comprising a pressure vessel containing a volume of a fire-extinguishing substance, the pressure vessel is connected to feed the fire-extinguishing substance to the sprinkler at a pressure that decreases appreciably after the sprinkler releases the volume of the fire-extinguishing substance.

8. A fire safety system to be positioned in a room of a building having a sprinkler, the fire safety system comprising:

a smoke detector;

a fire detector; and a ceiling fan to be mounted to a ceiling, the ceiling fan including a brake which is responsive to the smoke detector sensing a concentration of smoke above a first threshold to decelerate the ceiling fan to enable the fire detector to more accurately sense heat.

9. The fire safety system of claim 8, wherein the fire detector is unresponsive to the concentration of smoke reaching the first threshold, but outputs a signal to turn on the sprinkler in response to detecting more than a threshold amount of heat.

10. The fire safety system of claim 8, wherein the smoke detector is disposed at least partially in an updraft created by the ceiling fan.

11. The fire safety system of claim 8, flirt her comprising a pressure vessel containing a volume of a fire-extinguishing fluid, the pressure vessel is to feed the sprinkler the fire-extinguishing fluid at a pressure that decreases appreciably after the sprinkler releases the volume of the fire-extinguishing fluid.

12. A fire safety system to be positioned in a room of a building having a sprinkler, the fire safety system comprising:

a ceiling fan to be mounted to a ceiling, the ceiling fan including a brake to stop rotation of the fan;

a smoke detector at least partially disposed in an updraft created by the fan, the smoke detector being in communication with the brake to signal the brake to stop the fan in response to sensing a concentration of smoke above a first threshold; and a fire detector to output a signal to turn on the sprinkler in response to detecting more than a threshold amount of heat, the smoke detector and the fire detector being positioned such that the fire detector is to output the signal after the brake has been signaled by the smoke detector.

* * * * *

UNITED STATES PATENT AND TRADEMARK OFFICE

CERTIFICATE OF CORRECTION

PATENT NO. : 7,658,232 B2
APPLICATION NO. : 12/014518
DATED : February 9, 2010
INVENTOR(S) : Anderson et al.

It is certified that error appears in the above-identified patent and that said Letters Patent is hereby corrected as shown below:

Column 8, line 4 (claim 11): the text "flirt her" should be amended to read --further--

Signed and Sealed this

Thirtieth Day of March, 2010

David J. Kappos

David J. Kappos
*Director of the United States Patent and Trademark Office*